US007506947B2

(12) United States Patent
Uchida

(10) Patent No.: US 7,506,947 B2
(45) Date of Patent: Mar. 24, 2009

(54) INK JET PRINTING APPARATUS AND METHOD USING MEDIA SHAPE DETECTION

(75) Inventor: Haruo Uchida, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 339 days.

(21) Appl. No.: 11/072,394

(22) Filed: Mar. 7, 2005

(65) Prior Publication Data

US 2005/0200680 A1 Sep. 15, 2005

(30) Foreign Application Priority Data

Mar. 9, 2004 (JP) ..... 2004-066414

(51) Int. Cl.
*B41J 29/38* (2006.01)
*B41J 29/393* (2006.01)

(52) U.S. Cl. ..... 347/14; 347/9; 347/19

(58) Field of Classification Search ..... 347/19, 347/16

See application file for complete search history.

(56) References Cited

U.S. PATENT DOCUMENTS

| | | | | |
|---|---|---|---|---|
| 3,509,352 | A * | 4/1970 | Hick et al. | 250/559.42 |
| 5,397,192 | A * | 3/1995 | Khormaee | 347/37 |
| 5,794,927 | A | 8/1998 | Uchida | 271/3.18 |
| 5,821,968 | A | 10/1998 | Ohyama et al. | 347/104 |
| 5,940,092 | A | 8/1999 | Kashimura et al. | 347/8 |
| 6,109,745 | A * | 8/2000 | Wen | 347/16 |
| 6,409,305 | B1 * | 6/2002 | Elgee et al. | 347/37 |
| 6,634,819 | B2 | 10/2003 | Uchida | 400/691 |
| 6,753,975 | B1 * | 6/2004 | Hanson | 358/1.18 |
| 7,140,708 | B2 * | 11/2006 | Lawrence et al. | 347/19 |
| 7,224,482 | B2 * | 5/2007 | Shima | 358/1.18 |
| 2004/0189767 | A1 | 9/2004 | Kodama et al. | 347/101 |
| 2005/0140704 | A1 * | 6/2005 | Mitsunaga et al. | 347/5 |

FOREIGN PATENT DOCUMENTS

JP 2000-351205 12/2000

* cited by examiner

*Primary Examiner*—Luu Matthew
*Assistant Examiner*—Shelby Fidler
(74) *Attorney, Agent, or Firm*—Fitzpatrick, Cella, Harper & Scinto

(57) ABSTRACT

An ink jet printing method and an ink jet printing apparatus are provided which minimize an area to be printed that overruns from edge portions of the print medium, even for an irregular-shaped print medium. The printing apparatus has an overrunning ink reception opening formed in the platen as a notched portion to accommodate ink ejected beyond the edges of the print medium. When the edge portions of an irregular-shaped print medium are to be printed, a control is made to accommodate almost all volume of ink ejected beyond the edge portions in the overrunning ink reception opening. With this arrangement the amount of ink ejected from the edge portions of even the irregular-shaped print medium can be adjusted so that the interior of the platen and printing apparatus can be prevented from being contaminated and a wasteful ink consumption minimized, thus realizing a satisfactory "marginless printing."

10 Claims, 13 Drawing Sheets

INK JET PRINTING APPARATUS AND METHOD USING MEDIA SHAPE DETECTION

BACKGROUND OF THE INVENTION

1. Field of the Invention

The present invention relates to an ink jet printing apparatus and an ink jet printing method, and more particularly to a "marginless printing" (or a full-bleed printing) which prints an image edge to edge on a print medium of irregular shape that has undulations or inclined or curved edges in peripheral portions and holes of arbitrary shape in an intenor portion.

2. Description of the Related Art

Ink jet printing apparatus have seen rapid reductions in price and size in recent years and an increasing number of them are entering the market for personal use. There are growing demands on these ink jet printing apparatus for a variety of multiple functions in addition to improved image quality and faster printing speed, and useful functions for users are being realized one after another. For example, a printing construction for a so-called "marginless printing" that prints on a print medium edge to edge without a margin has become available.

In printing on a print medium edge to edge, to realize a secure, reliable "marginless printing" requires ejecting some volume of ink onto areas overrunning outwardly from the edges of the print medium. Thus, conventional ink jet printing apparatus must overcome important technical problems, i.e., it is necessary to minimize those printed areas overrunning from the edges of the print medium and a volume of ink applied to the overrunning areas and to prevent, as practically as possible, an interior of the printing apparatus from being contaminated by the ink applied to the overrunning areas. A few printing methods and constructions to solve these problems have been proposed, for instance, in Japanese Patent Application Laid-open No. 2000-351205. Also a number of printing apparatus employing these methods and constructions are currently available.

To minimize the size of the overrunning area and the amount of ink applied to the overrunning area during the "marginless printing," it is desired that the position of the edges of a print medium be determined as correctly as possible. In the conventional construction, since the print medium is assumed to have a rectangular shape and a regular size, such as A4 size or post card size, it is possible to recognize the front and rear edge positions and lateral edge positions of the print medium with a relatively simple means. That is, if the user sets a paper size on a printer driver screen and if a print medium is fed into the printing apparatus with one of the lateral ends of the print medium fixed and the front edge of the print medium is detected by some means, it is possible to determine the front and rear edge positions and the left and right edge positions of the print medium.

Now, the printing method as performed during the "marginless printing" in a conventional ink jet printing apparatus will be briefly described.

FIG. 1 is a perspective view showing how a "marginless printing" is performed on A4-size paper. In the figure, denoted 1 is a print head which is positioned and held on a carriage not shown and can be moved in a main scan direction indicated by an arrow B as it is guided along a guide shaft and a rail The print head 1 is provided with nozzles 1A of a black ink and nozzles 1B of color inks.

Designated 2 is a platen for holding a print medium 100. The platen 2 has a notched portion or overrunning ink reception opening 3 that receives ink applied outside the edge of the print medium 100 during the "marginless printing". The overrunning ink reception opening 3 extends in a direction of arrow B in which the print head 1 travels, so that it can receive ink droplets ejected from the print head 1 wherever the print head may be. It is noted that the overrunning ink reception opening 3 has widened portions 3A-3F extending in the print medium transport direction at positions corresponding to widthwise edges of different sizes of the print medium. In the figure, 3A represents a portion corresponding to the left edge of a print medium that constitutes a reference, 3C represents a portion corresponding to the right edge of a post card with its left edge aligned with the reference, 3B represents a portion corresponding to the right edge of an L-size photograph, 3D represents a portion corresponding to the right edge of a 2L-size photograph, 3E represents a portion corresponding to the right edge of a "4×6-inch"size, and 3F represents a portion corresponding to the right edge of A4-size and LTR-size. The figure shows an A4-size print medium 100 as an example.

FIG. 1 shows a state in which the print medium 100 is fed and a "marginless printing" by the print head 1 is about to start at a front edge portion 100A of the print medium. At this time the front edge portion 100A is situated directly above the overrunning ink reception opening 3 and the left and right edges directly above 3A and 3F. Ink droplets applied to a U-shaped area overrunning from the edge of the print medium 100 are all accommodated in the overrunning ink reception opening 3. With the print medium 100 positioned in this state, the print head 1 starts the marginless printing on the front edge portion 100A of the print medium as it moves in the main scan direction (arrow B direction).

The print head 1 has a nozzle column 1A for ejecting a black ink and nozzle columns 1B for ejecting a plurality of color inks Each of the nozzle columns has a plurality of nozzles arranged in a direction of arrow A at a predetermined pitch over a width D. When the front edge portion 100A of the print medium 100 is printed, not all nozzles in each nozzle column of each color are activated over the width D. As shown in the figure, only those nozzles that correspond to a particular width near the center, like a width C (<D) in the figure, are used for printing. By adopting this printing method, the ink droplets applied outside the front edge portion 100A can be securely accommodated in the overrunning ink reception opening 3. Further, by not setting the overrunning ink reception opening 3 unnecessarily large, a stability with which the platen 2 supports the print medium 100 can be prevented from deteriorating as practically as possible The front edge portion 100A is printed by alternately repeating the printing scan using the nozzle column width range C and the operation of feeding the print medium a corresponding distance. When, after the printing operation has proceeded, the front edge portion 100A well exceeds the nozzle column width range D, the printing on the front edge portion 100A is completed.

FIG. 2 is a perspective view showing a state in which the front edge portion 100A of the print medium 100 is completed and the "marginless printing" is being performed on a normal portion of the print medium. In the normal portion a full column width range D of the nozzle columns in the print head 1 is used. At positions on the platen 2 corresponding to a left edge portion 100B and a right edge portion 100C of the print medium 100 there are provided overrunning ink reception openings 3A and 3F which extend over a distance J, longer than the width D. Ink droplets applied outside the left and right edges of the print medium are reliably accommodated in the overrunning ink reception openings 3A and 3F. By repetitively alternating the printing scan using the column width range D in the print head and the print medium feeding over a corresponding distance, the printing on the normal portion is performed. When, after the printing has proceeded, a rear edge portion 100D approaches the column width range D in the print head, the printing on the normal portion is completed and transferred to the printing on the rear edge portion 100D.

FIG. 3 is a perspective view showing a state in which the printing on the normal portion is completed and a "marginless printing" is being performed on the rear edge portion 100D of the print medium 100. In the printing on the rear edge portion, the range C of the nozzle columns is activated as in the printing of the front edge portion. The rear edge portion 100D is situated directly above the overrunning ink reception opening 3 and the left and right edges are situated directly above 3A and 3F, so that ink droplets applied to a U-shaped area overrunning from the edge of the print medium 100 are all accommodated in the overrunning ink reception opening 3. When the printing on all the area of the print medium is complete, the print medium 100 is transported in the direction of arrow A by a transport means (not shown) and discharged.

FIG. 4 is a perspective view showing a state in which a "marginless printing" is being performed on a print medium 100 of photograph 2L-size. As described above, 3B-3F represent portions of the overrunning ink reception opening 3 having an increased width that are provided for different sizes of print medium. In the case of photograph 2L-size, its left edge portion and right edge portion are situated at positions 3A and 3D respectively. As described above, in the conventional ink jet printing apparatus, the "marginless printing" can be performed on any available size of the print medium, as in the case of A4-size print medium explained in FIG. 1 to FIG. 3.

To cope with a variety of uses in recent years, irregular shapes of print mediums have been made available which have undulations or inclined or curved edges in peripheral portions and holes in an interior portion thereof. While there are growing demands on the ink jet printing apparatus for a construction capable of performing a satisfactory printing on such irregular-shaped print mediums and for a marginless printing capability, the conventional construction has difficulty fully meeting these demands, as described in the section of related art. That is, in the ink jet printing apparatus of the conventional construction, since the print medium is assumed to have a regular, rectangular shape, the positions of edges of the print medium can be determined relatively easily. With irregularly shaped print mediums, however, the edge positions are difficult to determine, which in turn renders a correct printing impossible or results in applying ink to an area excessively overrunning from the edges, contaminating the interior of the printing apparatus.

SUMMARY OF THE INVENTION

The present invention has been accomplished to overcome the above-described problems and can provide an ink jet printing method and an ink jet printing apparatus which can recognize an area to be printed relatively precisely even for print mediums of irregular shapes and thereby minimize those areas overrunning from the edges of the print medium to which ink is applied.

In a first aspect of the present invention, there is provided an ink jet printing apparatus which can perform a printing operation to an irregular-shaped print medium by repeating a printing scan for printing to the print medium by ejecting ink from a print head having a plurality of ink ejection nozzles arranged in a predetermined direction during a scan of the print head in a direction crossing the predetermined direction, and sub-scan for feeding the print medium in a direction different from the direction of the printing scan, the ink jet printing apparatus comprising: platen that supports the print medium to be printed by the print head, wherein the platen is arranged in a position facing the print head and has an opening portion for receiving ink ejected beyond an edge portions of the print medium; and controller that causes the print head to perform a printing operation that uses a portion of the plurality of nozzles which faces the opening if the printing to the irregular-shaped print medium is performed.

In a second aspect of the present invention, there is provided an ink jet printing apparatus which can perform a printing operation on a print medium without leaving a margin in at least one edge portion of the print medium by repeating a printing scan for printing to the print medium by ejecting ink from a print head having a plurality of ink ejection nozzles arranged in a predetermined direction during a scan of the print head in a direction crossing the predetermined direction and a sub-scan for feeding the print medium in a direction different from the direction of the printing scan, the ink jet printing apparatus comprising: a platen that supports the print medium to be printed by the print head, wherein the platen is arranged in a position facing the print head and has an opening portion for receiving ink ejected beyond the edge portions of the print medium; and a controller that causes the print head to perform a printing operation using a part or all of the plurality of nozzles that matches a shape of the edge portions.

In a third aspect of the present invention, there is provided an ink jet printing apparatus which can perform a marginless printing mode for printing without providing margin on at least one edge portion of the print medium by using a print head for ejecting ink, the ink jet printing apparatus comprising: platen arranged in a position facing the print head to support the print medium to be printed by the print head; the platen having an opening portion for receiving ink ejected beyond the edge portions of the print medium during the marginless printing mode; detector that detects positions of edge portions of an irregular-shaped print medium, including those of a front edge portion, a rear edge portion and lateral edge portions, when the marginless printing mode is selected and the irregular-shaped print medium is selected; and generation means that generates print data corresponding to an area overrunning from the edge portions according to information on the positions of the edge portions detected by the detection means.

In a fourth aspect of the present invention, there is provided an ink jet printing apparatus which can perform a marginless printing mode for printing without leaving a margin in at least one edge portion of the print medium by using a print head for ejecting ink, the ink jet printing apparatus comprising: platen arranged in a position facing the print head to support the print medium to be printed by the print head; the platen having an opening portion for receiving ink ejected beyond the edge portions of the print medium during the marginless printing mode; and selecting means for selecting one of different printing operations to be performed on the print medium according to whether the print medium used is irregular-shaped or regular-shaped when the marginless printing mode is selected.

In a fifth aspect of the present invention, there is provided an ink jet printing method which performs a printing operation on a print medium without leaving a margin in at least one edge portion of the print medium by repeating a printing scan for printing on the print medium by ejecting ink from a print head having the plurality of ink ejection nozzles arranged in a predetermined direction during a scan of the print head in a direction crossing the predetermined direction, and a sub-scan for feeding the print medium in a direction different from the direction of the printing scan, the ink jet printing method comprising the steps of: preparing a platen that supports the print medium, the platen being arranged in a position facing the print head, the platen having an opening portion for receiving ink ejected beyond the edge portions of the print medium; and printing on the edge portions of the print medium by using a part or all of the plurality of nozzles that matches a shape of the edge portions.

In a sixth aspect of the present invention, there is provided an ink jet printing method executed in an ink jet printing apparatus, wherein the ink jet printing apparatus has a platen arranged in a position facing the print head to support the print medium to be printed by the print head, the platen having an opening portion for receiving ink ejected beyond the edge portions of the print medium during the marginless printing mode in which the printing operation is performed on the print medium without leaving a margin in at least one edge portion of the print medium; the ink jet printing method comprising the steps of: selecting either an irregular-shaped print medium or a regular-shaped print medium as a print medium to be used; detecting positions of edge portions of the irregular-shaped print medium, including those of a front edge portion, a rear edge portion and lateral edge portions, when the irregular-shaped print medium is selected in the selection step; and generating print data corresponding to an area overrunning from the edge portions according to information on the positions of the edge portions detected by the detection step.

In a seventh aspect of the present invention, there is provided an ink jet printing method executed in an ink jet printing apparatus having a platen arranged in a position facing the print head to support the print medium to be printed by the print head, the platen having an opening portion for receiving ink ejected beyond the edge portions of the print medium during the marginless printing mode in which the printing operation is performed on the print medium without leaving a margin in at least one edge portion of the print medium; the ink jet printing method comprising the steps of: selecting the marginless printing mode; selecting either an irregular-shaped print medium or a regular-shaped print medium as a print medium to be used; and when the marginless printing mode is selected and the irregular-shaped print medium is selected, detecting positions of edge portions of the irregular-shaped print medium, including those of a front edge portion, a rear edge portion and lateral edge portions, generating print data corresponding to an area overrunning from the edge portions according to a detection result obtained, and performing the marginless printing according to the generated print data, and when the marginless printing mode is selected and the regular-shaped print medium is selected, performing the marginless printing using predetermined print data as the print data corresponding to the overrunning area.

The above and other objects, effects, features and advantages of the present invention will become more apparent from the following description of embodiments thereof taken in conjunction with the accompanying drawings.

DETAILED DESCRIPTION OF PREFERRED EMBODIMENTS

Now, embodiments of the present invention will be described in detail.

A "marginless printings" as used in this specification means performing a printing without providing margin on at least one edge portion of the print medium. That is, the marginless printing refers not only to a form of printing that prints on an entire area of the print medium without leaving margin at all but also to a form of printing that prints without leaving margin only on a front edge portion, rear edge portion or left or right edge portion.

First Embodiment

Figure 1:
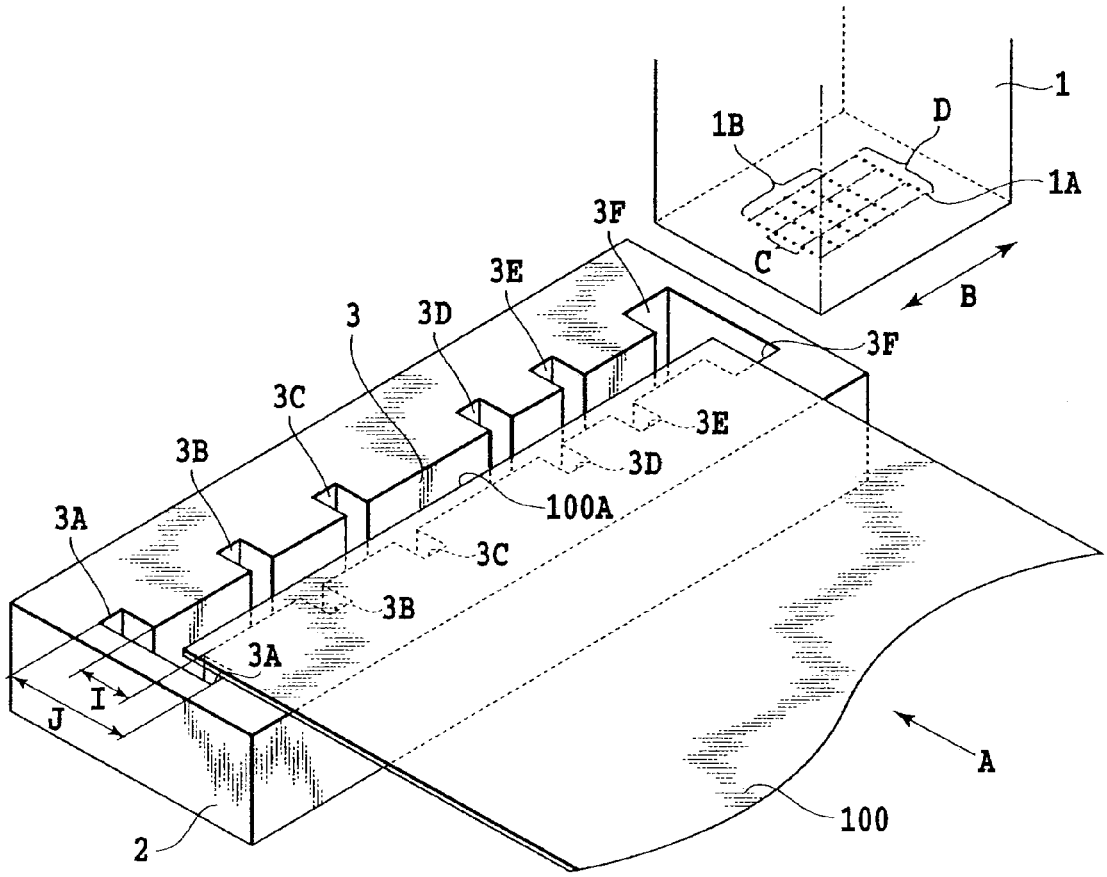
FIG. 1 is a perspective view showing how a "marginless printing" is performed on a regular-shaped print medium.
Figure 2:
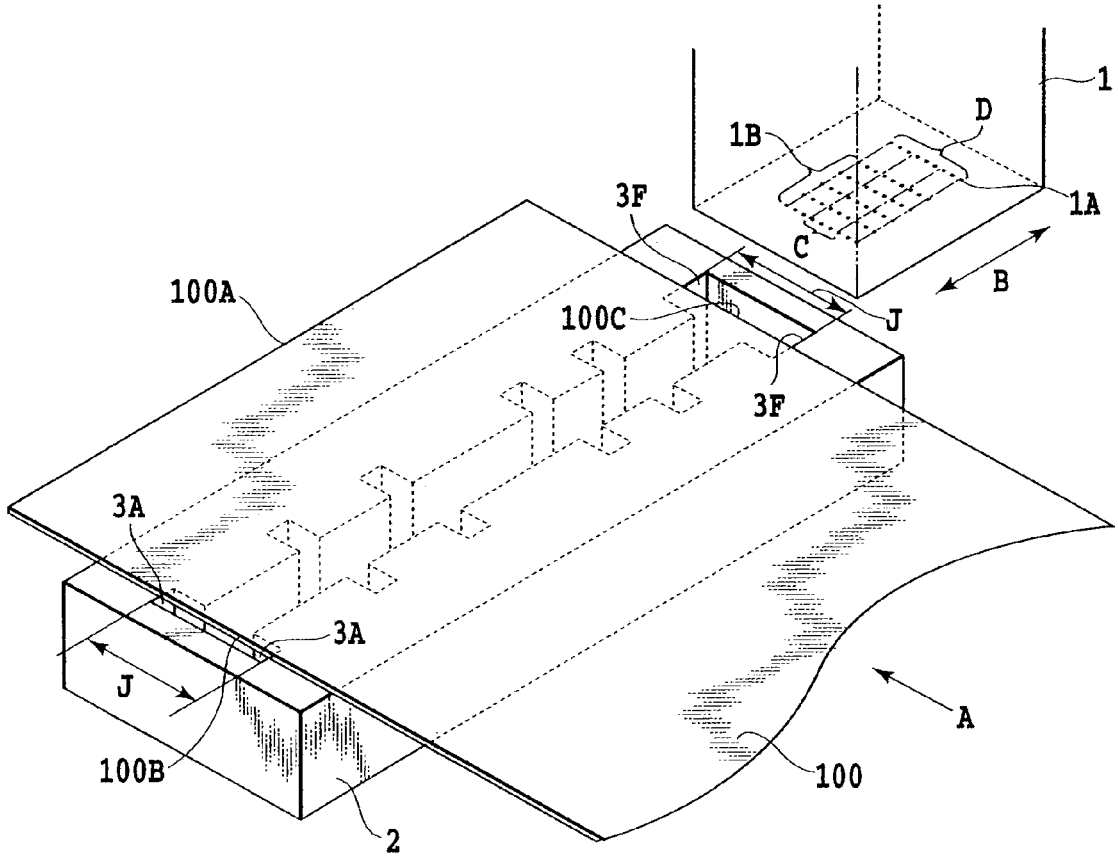
FIG. 2 is a perspective view showing how the "marginless printing" is performed on a normal portion of a print medium.
Figure 3:
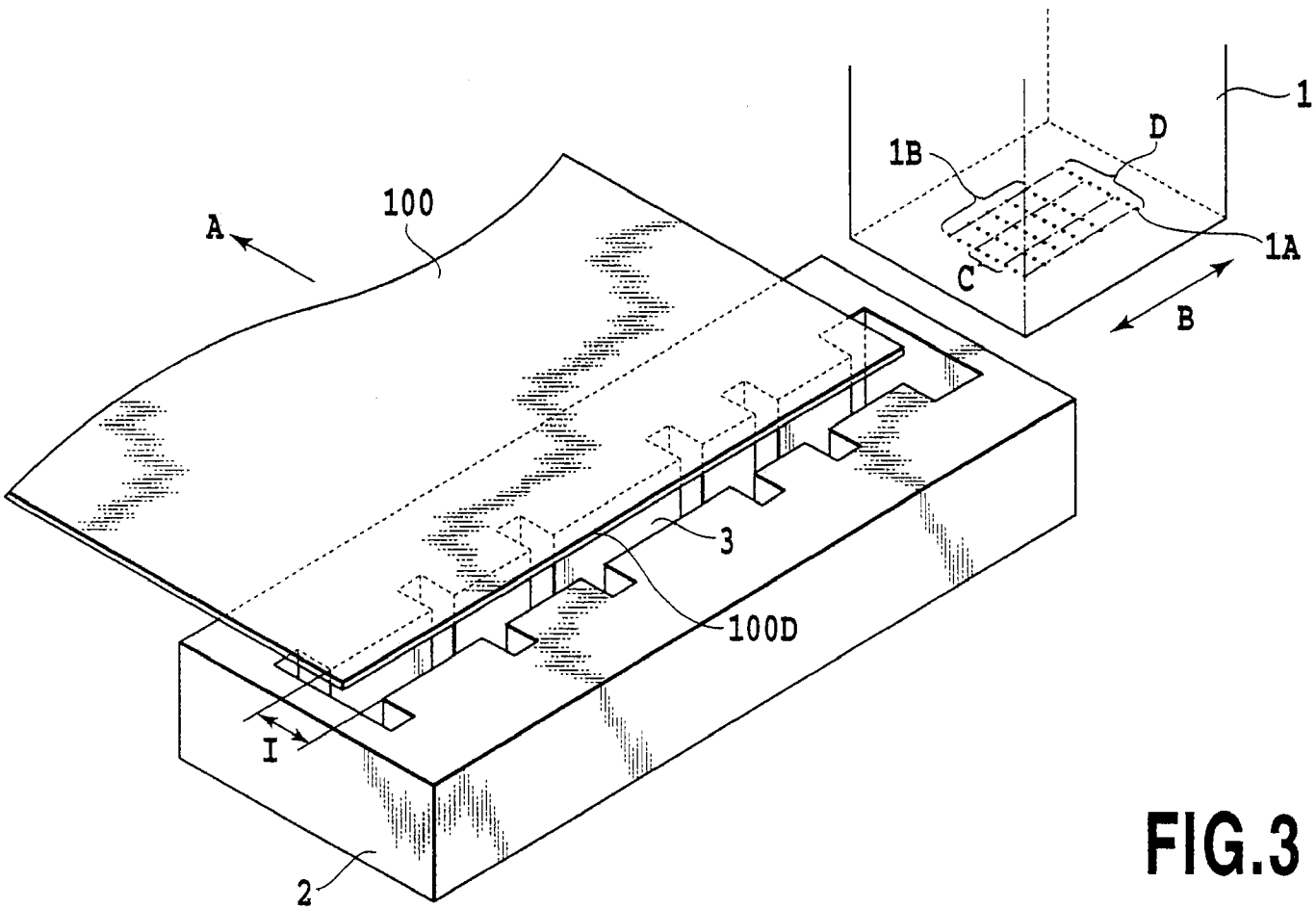
FIG. 3 is a perspective view showing how the "marginless printing" is performed on a rear edge portion of a print medium.
Figure 4:
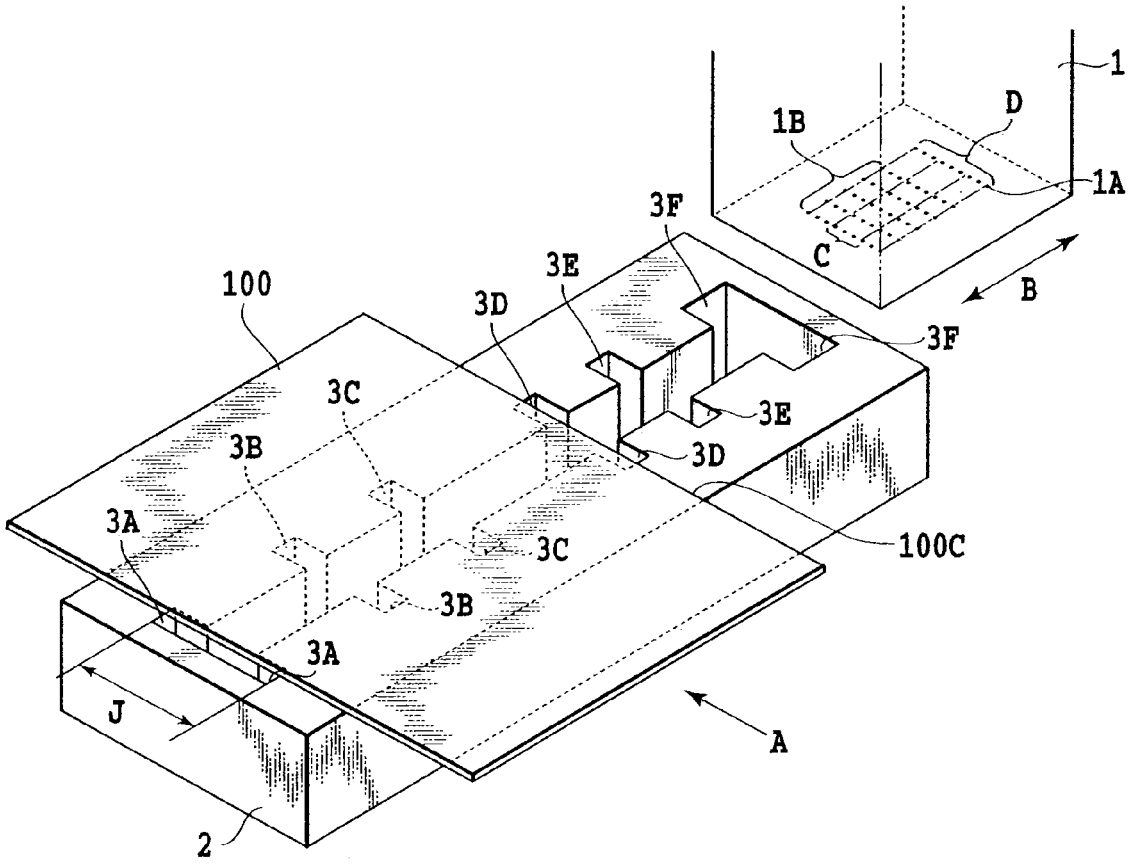
FIG. 4 is a perspective view showing how the "marginless printing" is performed on a 2L-photo size of a print medium.
Figure 5:
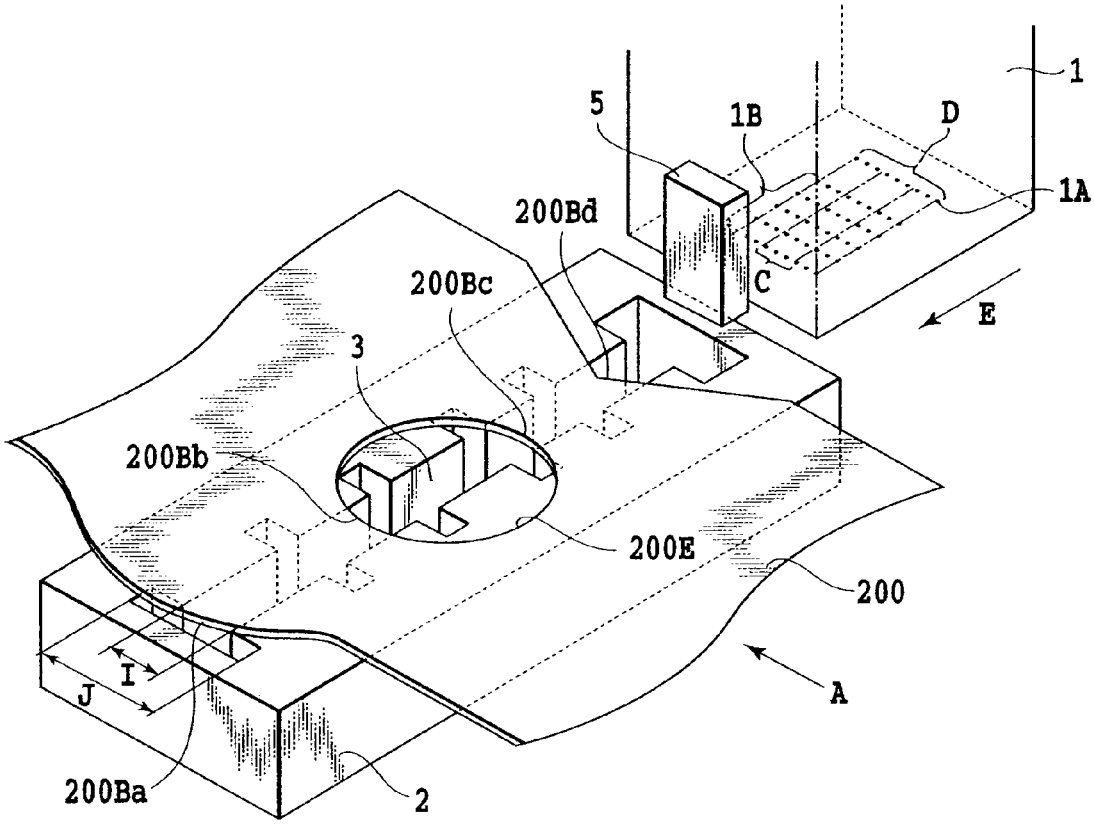
FIG. 5 is a perspective view showing how the "marginless printing" is performed on an irregular-shaped print medium in an ink jet printing apparatus as a first embodiment of this invention.

FIG. 5 is a perspective view showing how the "marginless printing" is performed on an irregular-shaped print medium 200 in an ink jet printing apparatus of this embodiment. Denoted 5 is a paper edge detection means, which is positioned and fixed in a carriage and can be reciprocally moved in a direction of arrow E together with the print head 1. The paper edge detection means 5 is constructed of, for example, a reflection type or transmission type optical sensor and detects the presence or absence of the print medium 200 thus recognizing the position of its edge. In other respects, the construction of the ink jet printing apparatus of this embodiment is similar to that explained with reference to FIG. 1 in the section of the related art.

Figure 6:
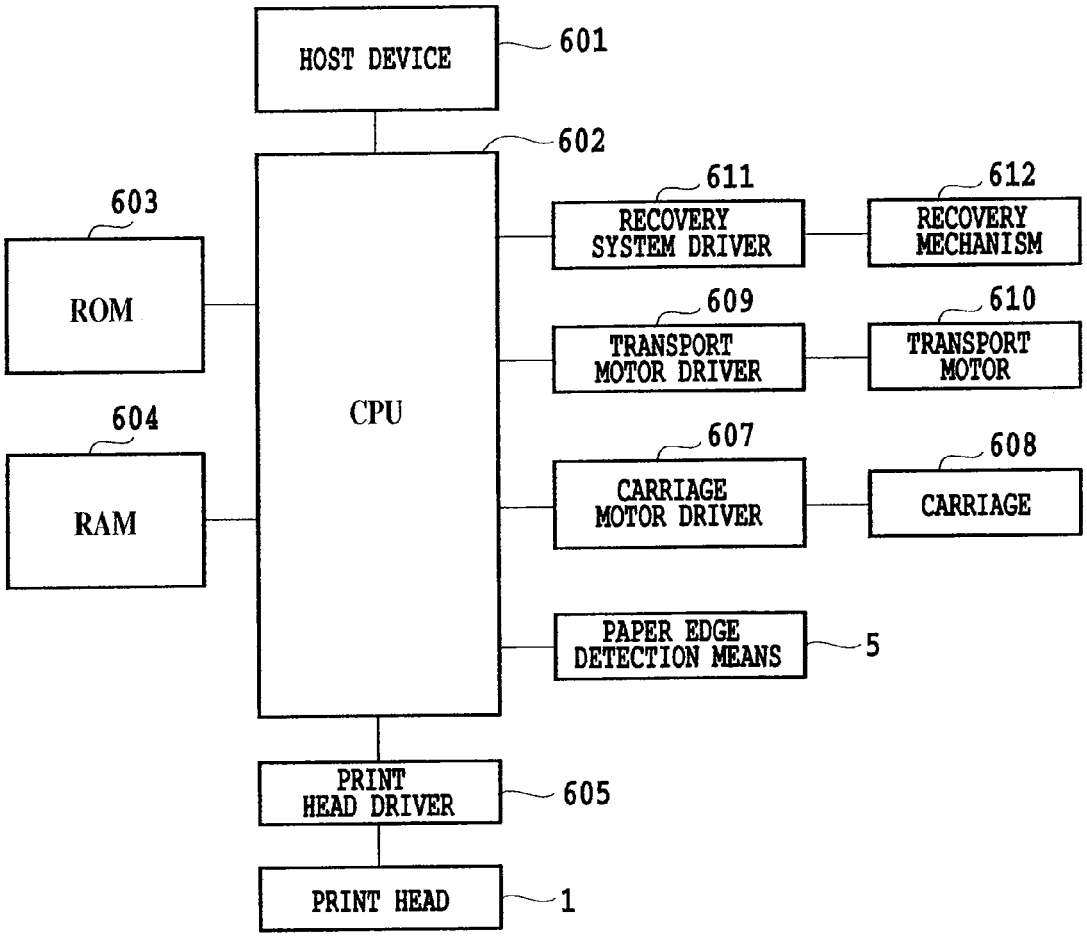
FIG. 6 is a block diagram showing a control system configuration in the ink jet printing apparatus as an embodiment of this invention.

FIG. 6 is a block diagram showing a control system configuration in the ink jet printing apparatus of this embodiment. Denoted 602 is a CPU which, according to an signal supplied from an externally connected host device 601, controls the entire printing apparatus as by performing a printing operation and a maintenance operation. A program executed by the CPU 602 is stored in a ROM 603. A RAM 604 is used as a work area for temporarily storing an image signal being processed.

Designated 605 is a print head driver for driving the print head 1. Reference number 607 represents a carriage motor driver to move a carriage 608 mounting the print head 1 and the paper edge detection means 5. Reference number 610 denotes a transport motor for feeding a print medium, and reference number 609 denotes a transport motor driver for driving the transport motor 610. The CPU 602, according to the image signal from the host device 601, controls the print head driver 605 to cause the print head 1 to eject ink. At the same time, the CPU 602 also controls a carriage motor driver 607 to move the carriage 608 in the main scan direction, forming an image of one printing scan on the print medium. By alternating this main printing scan and the feeding of the print medium by the transporting motor 610 over a predetermined distance, an image is successively formed on the print medium.

As explained in FIG. 5, the paper edge detection means 5 is provided in the carriage 608 and detects the presence or absence of the print medium as the carriage is moved. According to the detection result, the CPU 602 can control the printing method.

Denoted 612 is an ejection performance recovery mechanism to perform a series of maintenance operations on the print head 1. Denoted 611 is an ejection performance recovery driver to drive the recovery mechanism 612. At a predetermined timing while the printing is at rest or in operation, the CPU 602 controls the ejection performance recovery driver 611 to perform a maintenance operation on the print head 1.

Figure 7:
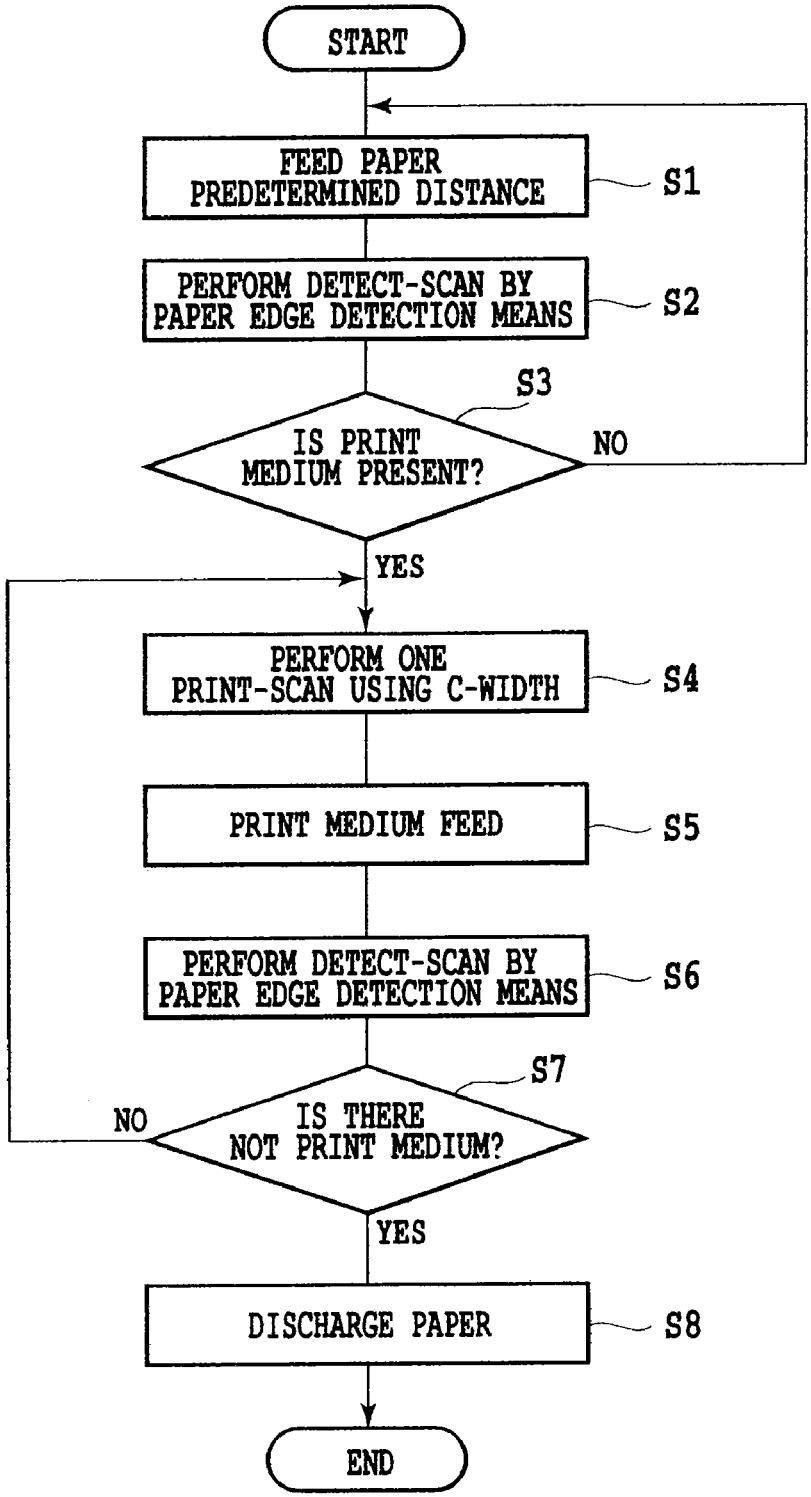
FIG. 7 is a flow chart showing a sequence of steps executed by a CPU in performing the "marginless printing"

FIG. 7 is a flow chart showing a series of steps executed by the CPU 602 in "marginless-printing" an image generated by a user on an irregular-shaped print medium. When the user enters a command via a printer driver in the host device, requesting a "marginless printing" to be performed on an irregular-shaped print medium, the printing apparatus first starts feeding a print medium (step S1).

With the predetermined paper feeding complete, the paper edge detection means 5 checks for the presence or absence of the print medium as the carriage 608 moves in the main scan direction (step S2).

In a next step S3, a check is made as to whether the front edge portion of the print medium has been detected by the carriage scan performed by step S2. If the front edge is not yet detected, the processing returns to step S1 and repeats executing step S1 to step S3 until the front edge of the print medium is detected.

Figure 8:
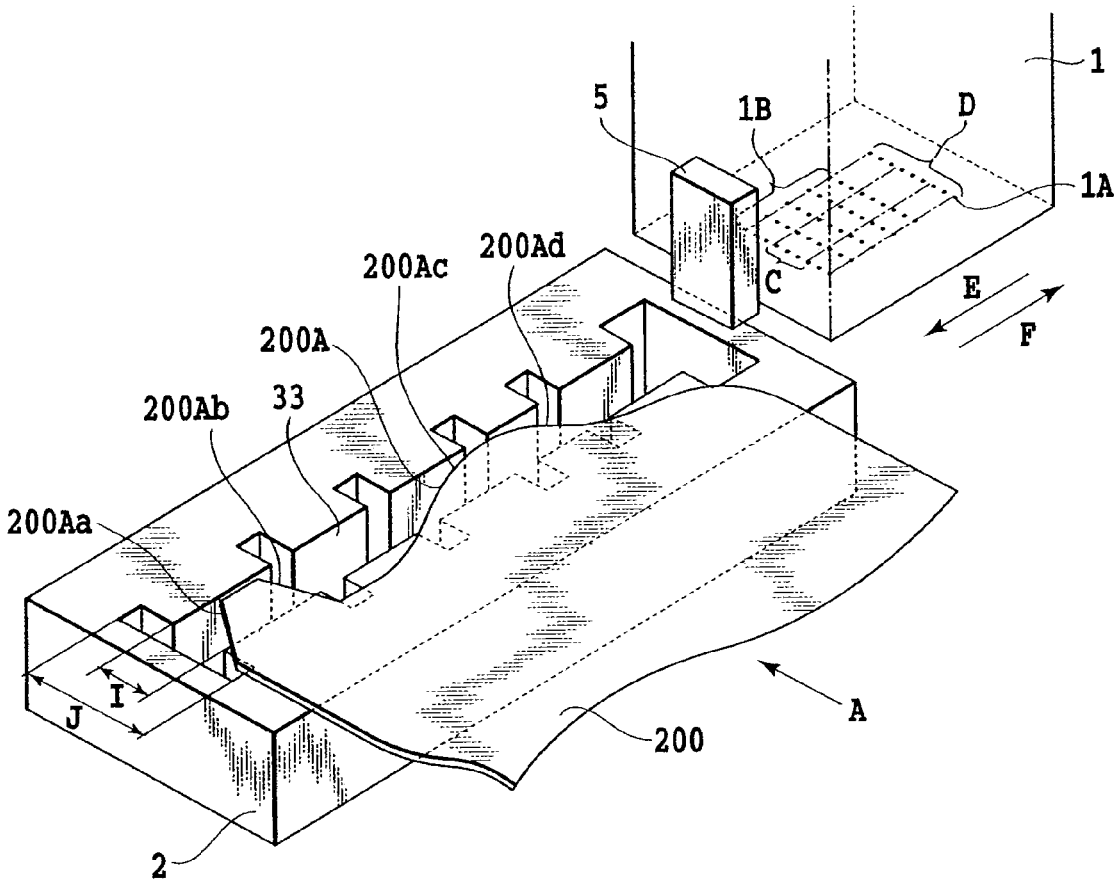
FIG. 8 is a perspective view showing how a front edge portion of an irregular-shaped print medium is printed.

FIG. 8 is a perspective view showing how the front edge of the front end portion of an irregular-shaped print medium is detected. In the figure, the paper edge detection means 5 moves in a direction of arrow E for detection of the front edge. Here it is assumed that four edge portions 200Aa, 200Ab, 200Ac and 200Ad at the front end 200A of the print medium have been detected. When the four edge portions are detected and the step S3 decides that there is a front edge portion, the processing moves to step S4.

In step 4, as the carriage moves in a direction of arrow F, a specified range of nozzle columns (width C) is used to print on the edge portion while keeping the overrunning distance from the edge to a predetermined amount. That is, on the outside of the detected edge portions 200Aa, 200Ab, 200Ac and 200Ad, a control is made to use the specified range of nozzle columns (width C) so that the ink ejection is kept within a predetermined overrunning distance from the edge. As described above, according to the information on the positions of the front edge portions detected, print data corresponding to an area overrunning from the front edge portion is generated. Based on the generated print data, the printing operation near the edge portion is performed.

In this embodiment, the control method is not limited to the one described above. The overrunning ink reception opening 3 has a groove width I, larger than the nozzle column width range C, over the whole length thereof in the width direction of the print medium. Thus, if ink is ejected to an area outside the detected edge or whatever shape the print medium has at the edge portion, the ink ejected to an area overrunning from the print medium is received in the overrunning ink reception opening 3 as long as the printing is performed using the nozzle column width range C.

After one printing scan is complete, the processing proceeds to step S5 where the print medium is fed a predetermined distance according to the nozzle column width range C. Next in step S6, the paper edge detection means 5 checks the presence or absence of the print medium and its edge position as the carriage 608 moves in the direction of arrow E. The above steps from S4 to S6 are repeated until step S7 decides that the print medium is not present.

Next, a method of controlling a printing operation performed on an irregular-shaped print medium having a hole at its central portion will be explained.

Even after the printing on the front edge portion is complete, the process from step S4 to step S6 is repeated to detect the paper edge portion by step S6 in each printing scan.

Figure 9:
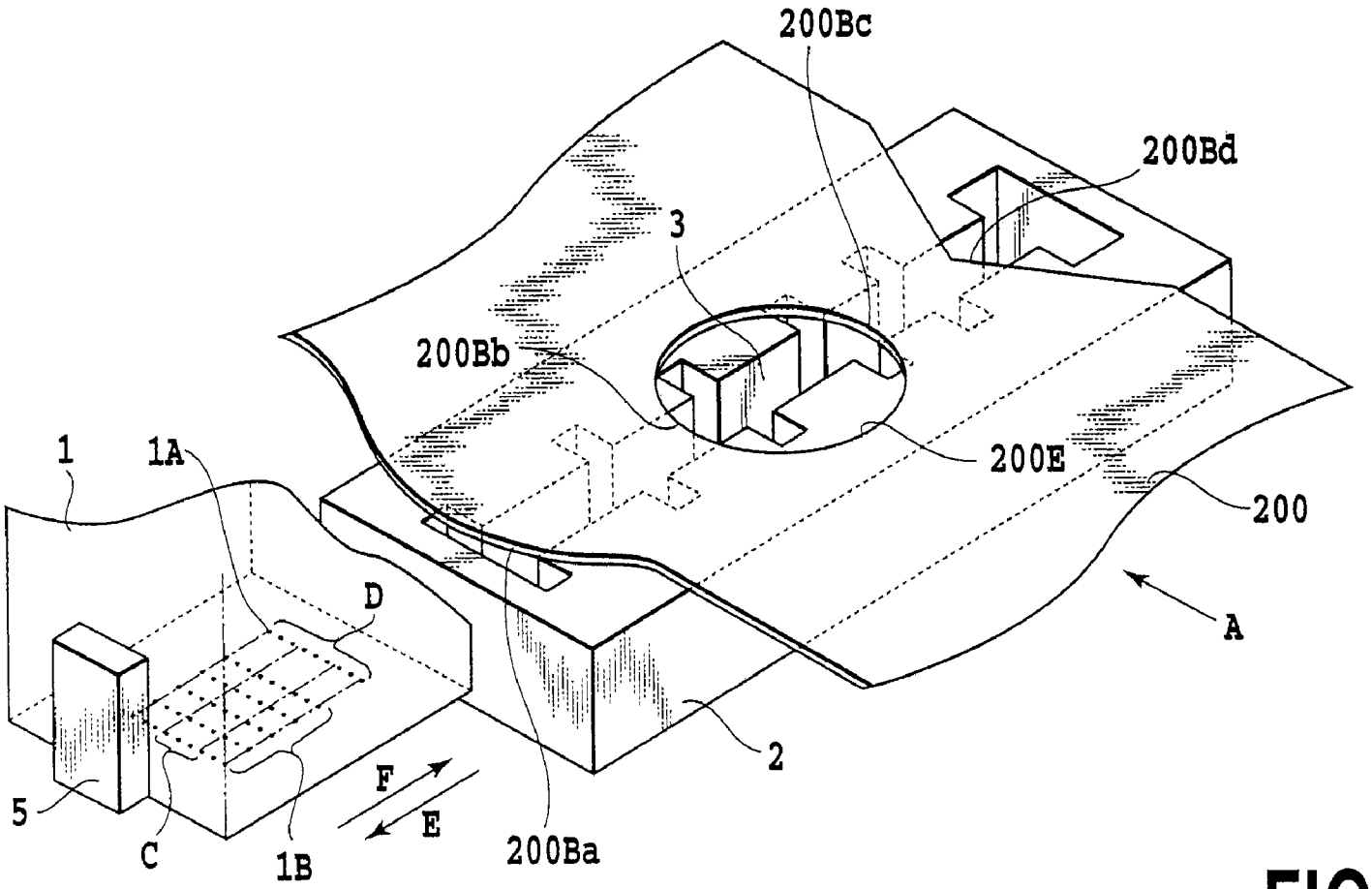
FIG. 9 is a perspective view showing how a central portion of the irregular-shaped print medium is printed.

FIG. 5 shows a state before the carriage is moved for detection of the paper edge and FIG. 9 shows a state in which the carriage has moved and completed the detection. Here, the process of printing on a print medium with a hole 200E formed at a central part thereof will be described. It is assumed that edge positions 200Ba, 200Bb, 200Bc and 200Bd have been detected by the scan performed in step S6 If a subsequent step S7 decides that the print medium is present, the processing returns to step S4, causing the carriage to move in an F direction and perform printing by keeping the overrunning distance from the edge to a predetermined amount. That is, on the outside of the detected edge portions 200Ba, 200Bb, 200Bc and 200Bd, a control is made to eject ink keeping within a predetermined overrunning distance from the edges, using the specified range of nozzle columns (width C). Here, according to the information on the positions of the central edge portion and the lateral edge portions detected, print data corresponding to areas overrunning from the central edge portion and the lateral edge portions is generated. Based on the generated print data, the printing operation near the edge portions is performed. As described above, whatever shape the print medium has at other than the front or rear edge portions, the ink ejected to areas overrunning from the print medium is received in the overrunning ink reception opening 3 as long as the printing is performed using the nozzle column width range C. It is noted, however, that if the print medium does not have a hole in it, as it has in the figure, the positions of the lateral edges are detected to control the overrunning distances from the lateral edges of the print medium during the printing operation.

When one printing scan is finished in step S4, the processing moves to step 5 where the print medium is fed a predetermined distance.

Figure 10:
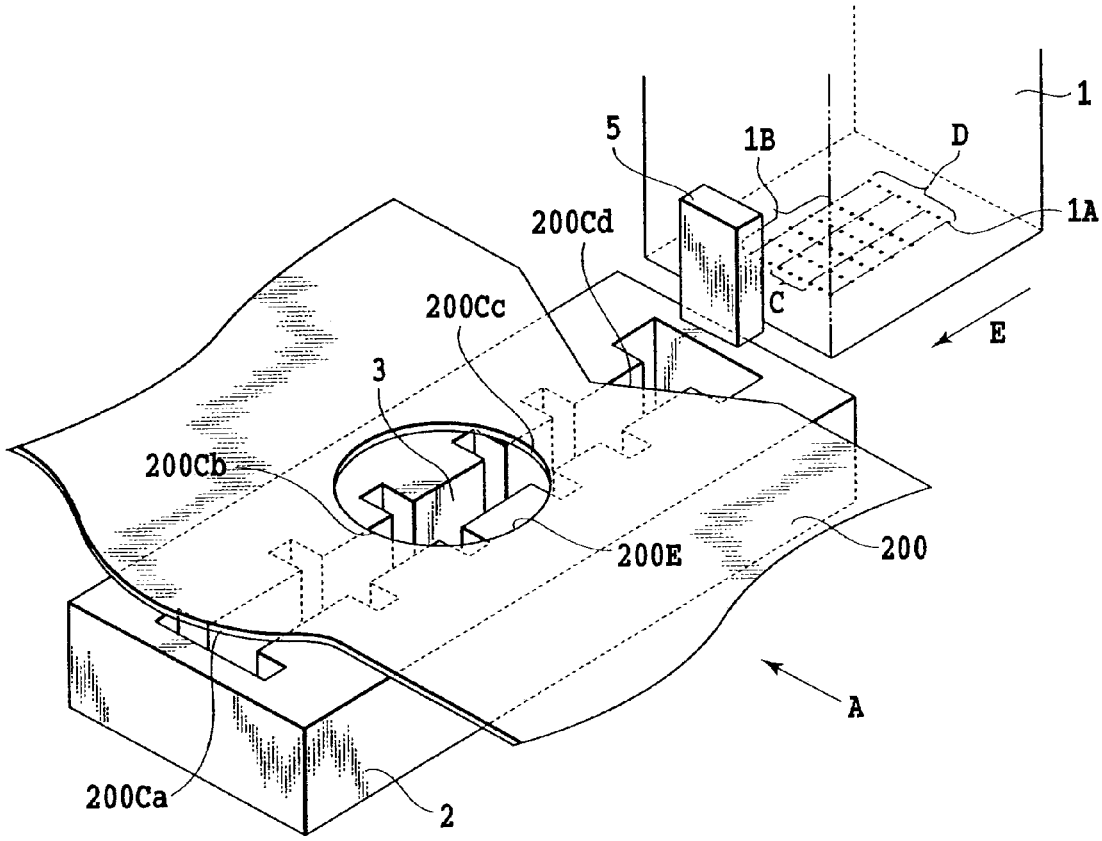
FIG. 10 is a perspective view showing how a central portion of the irregular-shaped print medium is printed.

FIG. 10 is a perspective view showing a state in which the print medium 200 is fed by step S5 a predetermined distance in the direction A from the state of FIG. 9. As the printing operation proceeds, the area with a hole is gradually moved in the direction A by the transporting action of step S5. Before each printing scan is performed in a direction F (step S4), an edge detection is always done in a direction E (step S6). For example, in FIG. 10, the detection scan by step S6 detects new edge positions 200Ca, 200Cb, 200Cc and 200Cd. Thus, in the next printing scan a printing control is performed according to the newly detected edge positions. It can be said therefore that whatever shape the hole or lateral edges have, the printing is always controlled to have a predetermined overrunning amount and the ink droplets applied to the overrunning areas are received in the overrunning ink reception opening 3.

Figure 11:
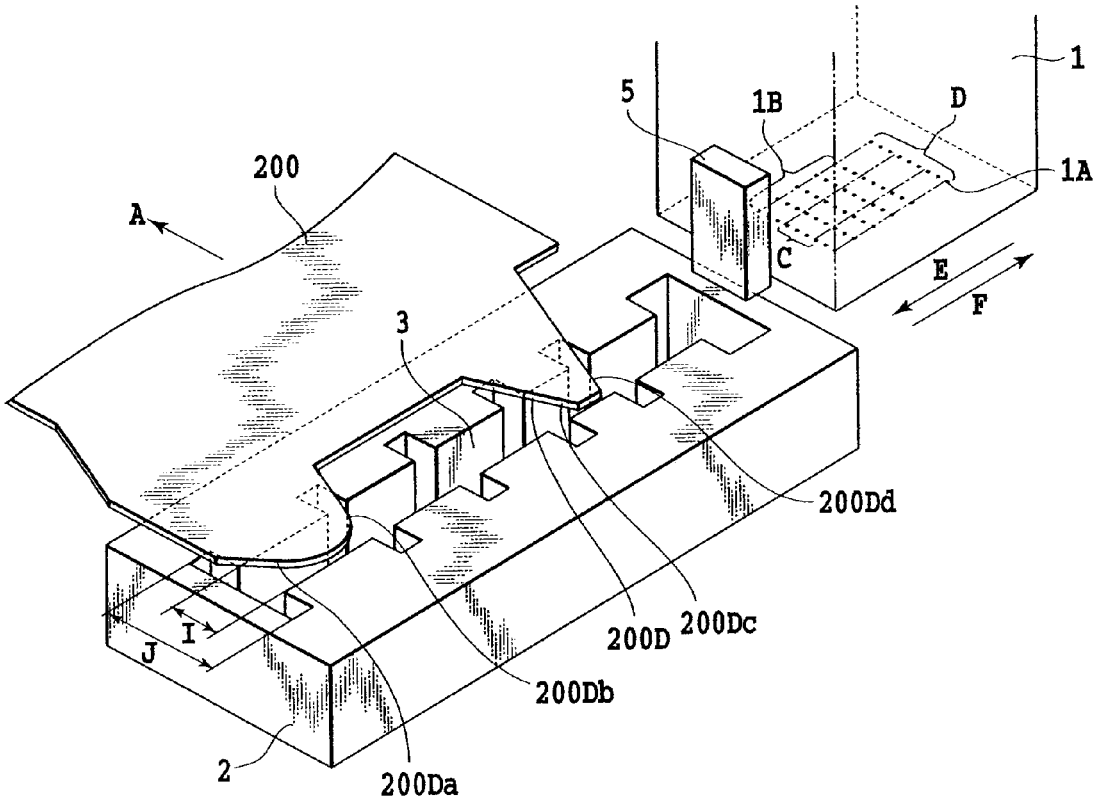
FIG. 11 is a perspective view showing how a rear edge portion of the irregular-shaped print medium is printed.

FIG. 11 is a schematic diagram showing how a rear edge portion 200D of the print medium is printed. For the rear edge portion also, step S6 detects edge positions 200Da, 200Db, 200Dc and 200Dd of the print medium 200 by moving the carriage In the direction E. In the subsequent step S7, if it is decided that the print medium is still present, the processing returns to step S4 causing the carriage to move in the direction F and perform printing on the edge portion using the nozzle column width range, and keeping the overrunning distance to the predetermined amount. That is, on the outside of the detected edge portions 200Da, 200Db, 200 Dc and 200Dd, a control is made to keep the ink ejection within a predetermined overrunning distance from the edges, using the specified nozzle column width range (width C). Here, according to the information on the positions of the rear edge portions detected, print data corresponding to areas overrunning from the rear edge portions is generated. Based on the generated print data, the printing operation near the edge portions is performed. As described above, in whatever shape the rear edge portion of the print medium is formed, the ink ejected to areas overrunning from the print medium is received in the overrunning ink reception opening 3 as long as the printing is performed using the nozzle column width range C.

After the printing on the rear edge portion of the print medium is finished, step S5 transports the print medium, followed by step S6 checking the presence of the print medium. If step S7 decides that a print medium to be printed is not present, the processing proceeds to step S8 where it discharges the print medium 200.

As described above, whatever shape a print medium has at its front edge portion, rear edge portion, lateral edge portions or central portion, this embodiment can detect the positions of edge portions of that area in the print medium which is to be scanned next for printing and, based on this information, can control the printing operation. Therefore, even for irregular-shaped print mediums, it is possible to perform a "marginless printing" with an appropriate overrunning distance from edges, without wasting ink. Further, since the nozzle column width range used for printing on edge portions and the width of the overrunning ink reception opening 3 are designed to be in an appropriate relation with each other, a possible contamination of the interior of the printing apparatus with ink applied to the overrunning areas can be minimized.

In the above description, the carriage scan to detect edge positions of a print medium by the paper edge detection means 5 and the carriage scan to perform printing are provided as separate scans that are performed in two different directions. However, the present invention is not limited to the above method. For example, to perform both the detection scan and the printing scan over the edge portion in the same direction, two scans may be performed in the same direction over the same area of the print medium; or an edge position detection and a printing scan may be performed in one and the same scan. In the latter case, the paper edge detection means 5 may be mounted in front of the print head in the printing scan direction. This arrangement allows the carriage scan in the direction E to perform both the detection of the edge positions and the control of printing according to this information, which in turn is expected to enhance the printing speed. It is noted, however, that since the processing for converting the result of detection by the paper edge detection means 5 into the overrunning distance needs to be performed at high speed, new problems may arise, such as a become more complicated apparatus and a reduced traveling speed of the carriage. With these points considered, it can be said that this embodiment is advantageous if an appropriate control method is applied according to the construction of the printing apparatus and to a target throughput and cost.

Further, in the above description we have explained, with reference to FIG. 5 and FIG. 8 to FIG. 11, about the construction in which the overrunning ink reception opening 3 is provided in the printing apparatus. It is also possible to install an ink absorbing material in the overrunning ink reception opening 3.

Figure 12:
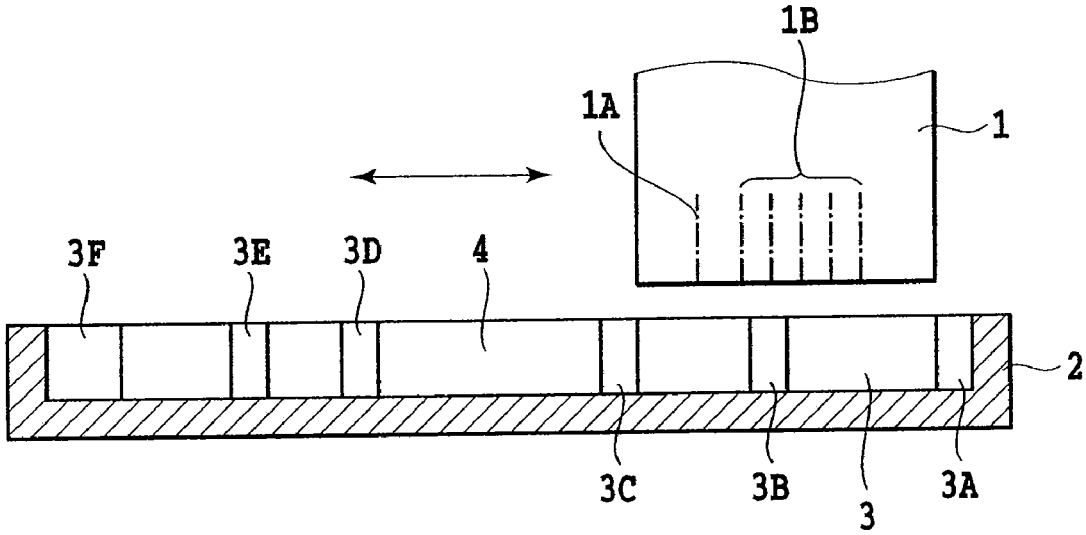
FIG. 12 is a cross-sectional view of a platen having an absorbent in an overrunning ink reception opening.

FIG. 12 is a cross-sectional view of the platen 2 having an ink absorbent 4 in the overrunning ink reception opening 3. In the figure, the overrunning ink reception opening 3 in the platen 2 including the portions 3A-3F extending in the transport direction is filled with the ink absorbent 4. With this arrangement, ink ejected beyond the edges of a print medium can be absorbed instantly, further minimizing the contamination of the interior of the printing apparatus with ink mist and splashes.

Further, in the above construction the user is required to make a setting in advance for printing on an irregular-shaped print medium by using a printer driver. This embodiment is not limited to this arrangement. There may be cases where, even if the user has made a setting for the printing of a regular-shaped print medium, he or she may wrongly supply an irregular-shaped sheet or may feed a sheet in a folded state. In such cases, the use of the paper edge detection means that detects edge positions of the print medium for each printing scan, as in this embodiment, allows for an automatic switching to the printing method for an irregular-shaped print medium. More specifically, even with a regular-shaped print sheet selected by the printer driver, if the positions or number of edge portions as detected by the paper edge detection means 5 are found to differ from those of the regular-shaped print medium, the CPU decides that the sheet supplied is irregular-shaped and thus performs the above-described printing control that uses the nozzle column width range C. By performing such a control in addition to the printer driver setting, it is possible to prevent the platen from being contaminated inadvertently.

Second Embodiment

Now, a second embodiment of this invention will be described. In this embodiment too, the construction of the print head and the configuration of the control system as explained with reference to FIG. 6 are similar to those of the first embodiment. In the first embodiment when an irregular-shaped sheet is to be printed, the printing operation has been described to be performed using the narrower-than-normal width range C. In this embodiment, however, the printing is done using the full width range D.

Figure 13:
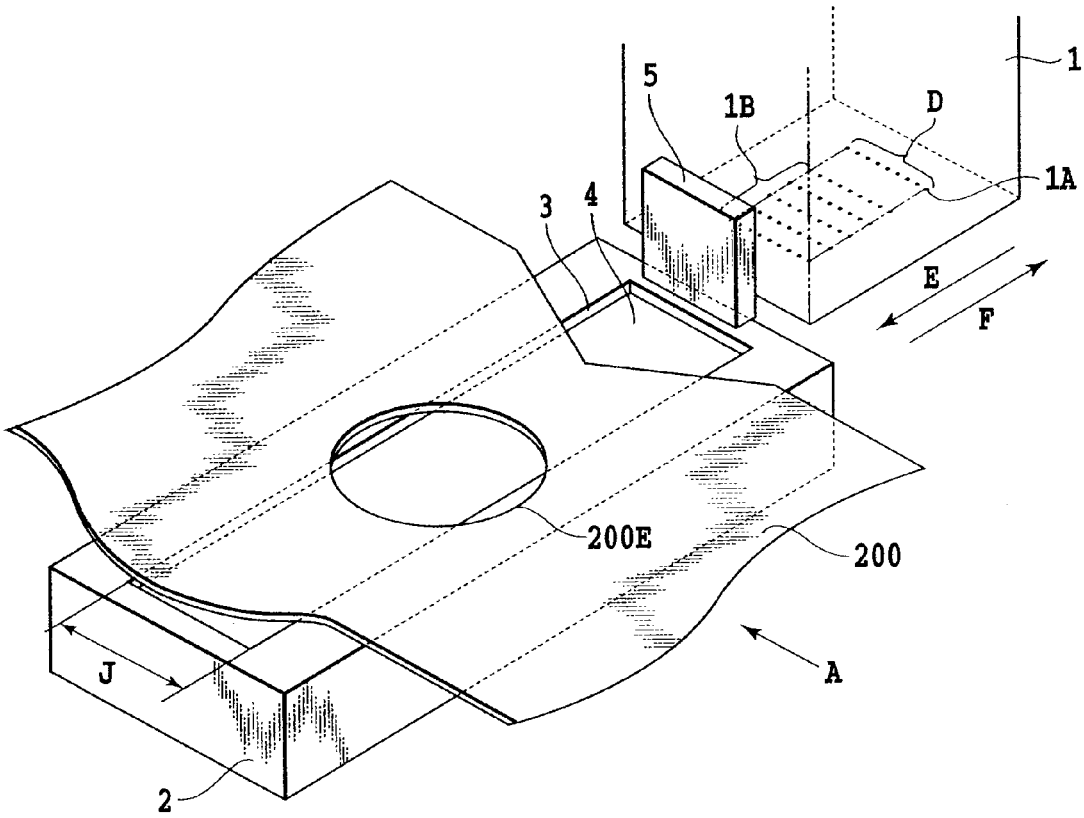
FIG. 13 is a perspective view showing how the "marginless printing" is performed on an irregular-shaped print medium in an ink jet printing apparatus as a second embodiment of this invention.

FIG. 13 is a perspective view showing how the "marginless printing" is performed on an irregular-shaped print medium 200 in an ink jet printing apparatus of this embodiment. In this embodiment, an opening having a greater width J than the full nozzle column width range D over its entire length in the print medium widthwise direction is provided as an overrunning ink reception opening 3. Inside the overrunning ink reception opening 3 is installed an ink absorbent 4. With this construction, ink droplets ejected beyond the edges of the print medium are reliably absorbed by the ink absorbent 4 if the print medium is irregular-shaped or "marginless-printed". Thus, it is possible to control the printing operation using the full nozzle column width range D without contaminating the interior of the printing apparatus, whatever shape the print medium has or whether the print medium Is present or not. It is noted, however, that an area where the platen 2 supports the print medium 200 is narrower than in the first embodiment, so that there is a concern that a stability of the print medium in the printing area may be lost. Therefore, it can be said that this embodiment is suited for a printing apparatus that uses print mediums with a relatively high stiffness and strength.

With this embodiment as described above, if an irregular-shaped print medium is chosen by a printer driver or a "marginless printing" is selected, there is no need to switch to the printing control that uses a particular nozzle column width range C, thus ensuring a relatively simple construction and a faster printing speed.

Third Embodiment

Now, a third embodiment of this invention will be described. In this embodiment too, the construction of the print head, the configuration of the control system as explained with reference to FIG. 6, and the perspective view such as shown in FIG. 5 are similar to those of the first embodiment. In this embodiment, however, the paper edge detection means is not provided on the side of the carriage as in the preceding embodiment. When a user selects an irregular-shaped sheet as by a printer driver, this embodiment executes a printing operation using the narrower-than-normal width range C without detecting the positions of edge portions in each printing scan. With this arrangement, if an irregular-shaped print medium is to be printed, it is not necessary to perform a complicated printing control during each printing scan in order to form an image without contaminating the interior of the printing apparatus.

Fourth Embodiment

A fourth embodiment of this invention will be explained as follows. In this embodiment too, the construction of the print head, the configuration of the control system as explained with reference to FIG. 6 and the perspective view such as shown in FIG. 5 are similar to those of the first embodiment In this embodiment, however, the paper edge detection means is not provided on the side of the carriage as in the preceding embodiment. In this embodiment, a line sensor is arranged in a direction crossing the print medium transport direction in a region ranging from where the print medium is fed to where it reaches the printing area. This line sensor is used as a paper edge detection means.

This embodiment switches between a printing using the nozzle column width range D and a printing using the nozzle column width range C according to the shape of the print medium. That is, if detected positions of edge portions of the print medium are only the lateral edge portions situated at 3A-3F, for example, the printing operation using the nozzle column width range D and the corresponding print medium feeding are performed. If detected position of edge portions of the print medium are not only the lateral edge portions, the printing operation using the nozzle column with range C and the corresponding print medium feeding are preformed too. It is therefore possible to complete the printing in a shorter time than that taken by the printing scan using the nozzle column width range C.

Other Embodiments

In the first and second embodiment, the "marginless printing" for only an irregular-shaped print medium has been described. The ink jet printing apparatus explained in these embodiments are capable of not only a "marginless printing" for irregular-shaped print mediums but also a "marginless printing" for regular-shaped print mediums.

In the case of the "marginless printing" for regular-shaped print mediums, conventionally known processing such as explained in the section of related art is executed. Thus, a variety of special processing such as executed when performing a "marginless printing" for irregular-shaped print mediums are not required. That is, the detection processing to detect the positions of edge portions, including the front edge portion, rear edge portion and lateral edge portions, during the scan of the carriage and the data generation processing to generate, according to the information on the detected edge positions, print data that corresponds to an area overrunning from the edges are not required for the printing of a regular-shaped print medium. In the case of a regular-shaped print medium, the print data corresponding to the overrunning area is determined beforehand.

Which of a "marginless printing" for regular-shaped print mediums and a "marginless printing" for irregular-shaped print mediums is executed depends on whether an "irregular-shaped print medium" or a "regular-shaped print medium" is selected by a printer driver or printing apparatus.

As described above, since it is possible to control the amount of ink applied beyond the edges of even an irregular-shaped print medium, a satisfactory "marginless printing" can be performed without contaminating the interior of the platen or printing apparatus or without consuming ink wastefully.

The present invention has been described in detail with respect to preferred embodiments, and it will now be apparent from the foregoing to those skilled in the art that changes and modifications may be made without departing from the invention in its broader aspects, and it is the intention, therefore, that the appended claims cover all such changes and modifications as fall within the true spirit of the invention.

This application claims priority from Japanese Patent Application No.2004-66414 filed Mar. 9, 2004, which is hereby incorporated by reference herein.

What is claimed is:

1. An ink jet printing apparatus which can print an image on a print medium by performing a printing scan for printing the image on the print medium by ejecting ink from a print head having a plurality of ink ejection nozzles arranged in a predetermined direction during a scan of the print head in a direction crossing the predetermined direction, and a feeding operation for feeding the print medium in a direction different from the direction of the printing scan, the ink jet printing apparatus comprising:

a platen that supports the print medium to be printed by the print head, wherein the platen is arranged in a position facing the print head and has an opening portion for receiving ink ejected beyond edge portions of the print medium; and a controller that causes the print head to eject the ink by using at least part of nozzles which face the opening portion without using nozzles which do not face the opening portion in all printing scans regardless of the image to be printed, if the print medium on which the image is to be printed is an irregular-shaped print medium.

2. An ink jet printing apparatus according to claim 1, wherein, if the print medium on which the image is to be printed is a regular-shaped print medium, the nozzles which face the opening portion and nozzles which do not face the opening portion are usable.

3. An ink jet printing apparatus according to claim 1, further including a detector which detects positions of edge portions of the print medium, wherein the controller generates print data corresponding to an overrunning area that overruns from the irregular-shaped print medium according to information on the positions detected by the detector, and causes the print head to eject the ink on a neighborhood of the edge portions of the irregular-shaped print medium according to the generated print data.

4. An ink jet printing apparatus according to claim 3, wherein the detector is constructed to scan together with the print head, and a detection scan for detecting the edge portions of the print medium by the detector is performed in a scan different from the printing scan.

5. An ink jet printing apparatus according to claim 3, wherein the detector is constructed to scan together with the print head, and a detection scan for detecting the edge portions of the print medium by the detector is performed in the printing scan.

6. An ink jet printing apparatus according to claim 1, wherein an ink absorbent for absorbing ink is installed in the opening portion.

7. An ink jet printing apparatus, comprising:

means for performing a marginless printing mode for printing an image without leaving a margin on at least one edge portion of a print medium by performing a printing scan for printing the image on the print medium by ejecting ink from a print head having a plurality of ink ejection nozzles arranged in a predetermined direction during a scan of the print head in a direction crossing the predetermined direction; and a platen that supports the print medium to be printed by the print head, the platen being arranged in a position facing the print head and having an opening portion for receiving ink ejected beyond the edge portions of the print medium by the marginless printing mode, wherein only nozzles which face the opening portion, not nozzles which do not face the opening portion, are usable in all printing scans regardless of the image to be printed, if the print medium to be used in the marginless printing mode is an irregular-shaped print medium.

8. An ink jet printing apparatus which can perform a marginless printing operation for printing an image without providing a margin on at least one edge portion of an irregular-shaped print medium by scanning a print head relative to the irregular-shaped print medium, the ink jet printing apparatus comprising:

an ink receiving portion for receiving ink ejected beyond the edge portions of the irregular-shaped print medium in the marginless printing operation;

a detector that detects positions of the edge portions of the irregular-shaped print medium before the marginless printing operation is performed; and a controller that generates print data corresponding to an overrunning area that overruns from the edge portions of the irregular-shaped print medium according to information on the positions of the edge portions detected by the detector, and performs the marginless printing operation according to the generated print data, wherein the marginless printing operation is performed by using at least part of nozzles which face the ink receiving portion and prohibiting use of nozzles which do not face the ink receiving portion in all printing scans of the print head regardless of the image to be printed.

9. An ink jet printing method which prints an image on an irregular-shaped print medium by ejecting ink from a print head having a plurality of ink ejection nozzles, comprising the steps of:

performing printing scans for scanning the print head relative to the irregular-shaped print medium in order to print the image on the irregular-shaped print medium;

feeding the print medium on a platen having an opening portion for receiving ink ejected beyond edge portions of the print medium; and printing on the irregular-shaped print medium by using at least part of nozzles which face the opening portion without using nozzles which do not face the opening portion in all printing scans regardless of the image to be printed.

10. An ink jet printing method executed in an ink jet printing apparatus including a platen having an opening portion for receiving ink ejected beyond an edge portion of a print medium in a marginless printing operation for printing an image on the print medium without leaving a margin on at least one edge portion of the print medium, the ink jet printing method comprising the steps of:

selecting either an irregular-shaped print medium or a regular-shaped print medium as a print medium to be used;

using only nozzles which face the opening portion without using nozzles which do not face the opening portion in all printing scans of a print head regardless of the image to be printed when the marginless printing operation is performed on the irregular-shaped print medium; and using nozzles which face the opening portion and nozzles which do not face the opening portion when the marginless printing operation is performed on the regular-shaped print medium.

* * * * *